US010450710B2

(12) United States Patent
Moore

(10) Patent No.: US 10,450,710 B2
(45) Date of Patent: Oct. 22, 2019

(54) SNOW REMOVAL SYSTEM AND METHOD

(71) Applicant: Ron Matthew Moore, Auburn, NY (US)

(72) Inventor: Ron Matthew Moore, Auburn, NY (US)

( * ) Notice: Subject to any disclaimer, the term of this patent is extended or adjusted under 35 U.S.C. 154(b) by 58 days.

(21) Appl. No.: 15/459,397

(22) Filed: Mar. 15, 2017

(65) Prior Publication Data

US 2017/0268190 A1 Sep. 21, 2017

Related U.S. Application Data

(60) Provisional application No. 62/308,448, filed on Mar. 15, 2016.

(51) Int. Cl.

| | |
|---|---|
| ***E01H 5/00*** | (2006.01) |
| ***E01H 5/04*** | (2006.01) |
| *E01H 5/02* | (2006.01) |
| *E01H 5/06* | (2006.01) |

(52) U.S. Cl.

CPC ..... *E01H 5/00* (2013.01); *E01H 5/045* (2013.01); *E01H 5/02* (2013.01); *E01H 5/061* (2013.01)

(58) Field of Classification Search

CPC .. E01H 5/00; E01H 5/045; E01H 5/02; E01H 5/061; E01C 13/08; A01G 13/0287; A01G 2013/0218; A01G 20/43; B62B 15/007; B62B 2202/50; B62B 2207/00

See application file for complete search history.

(56) References Cited

U.S. PATENT DOCUMENTS

| | | | | |
|---|---|---|---|---|
| 2,974,971 A * | 3/1961 | Buck | A01G 20/30 280/19 |
| 3,355,187 A * | 11/1967 | Brindle | B65G 7/02 280/19 |
| 4,046,393 A * | 9/1977 | Vadnais | B62B 15/00 280/19 |
| 4,335,891 A * | 6/1982 | Alley | B62B 15/00 224/921 |

(Continued)

OTHER PUBLICATIONS

Bryan Horwath, "City aims to have all streets in Dickinson Cleared of snow sometime Wednesday", Dickinson Press; Apr. 16, 2013 http://www.thedickinsonpress.com/news/1824548-city-aims-have-all-streets-dickinson-cleared-snow-sometime-wednesday (Year: 2013).*

*Primary Examiner* — Jamie L McGowan
(74) *Attorney, Agent, or Firm* — Whitley Legal Group, PC; AnnMarie W. Whitley

(57) ABSTRACT

A system for removing snow from easily damaged surfaces such as artificial turf athletic fields includes a modified snow blower used in combination with a vehicle towing a sled. The sled can be a large polymer sheet with side straps and draw bars at one or both ends. The sled also includes tow straps or other attachments for coupling to the vehicle. The snow blower, which can be independent or driven by another vehicle, is modified to cover its cutting edge with an edge guard and to include a set of wheels behind the auger housing. In operation, the snow blower can travel alongside the vehicle and sled and discharge snow onto the sled. When desirable, the sled can be towed to a snow discharge area and emptied. For best results, the snow blower should travel at a constant speed while the sled travels at a variable speed.

3 Claims, 11 Drawing Sheets

(56) References Cited

U.S. PATENT DOCUMENTS 4,364,575 A * 12/1982 Schlumberger ..... B62B 13/00 280/14.26
4,366,949 A * 1/1983 Staub, Sr. ..... A01G 20/30 256/1
4,405,673 A * 9/1983 Fridley ..... B65G 7/02 108/51.3
4,693,504 A * 9/1987 Baker ..... A01G 20/30 294/219
5,104,133 A * 4/1992 Reiner ..... A01G 20/30 280/19
D327,345 S * 6/1992 Lammon ..... 383/117
5,417,462 A * 5/1995 Hensley ..... A01G 20/30 294/212
5,529,321 A * 6/1996 Thompson ..... A01B 59/042 280/19
5,664,886 A * 9/1997 Hutchinson ..... A01G 20/30 383/4
5,967,532 A * 10/1999 Mooney ..... A01K 97/01 180/186
6,090,466 A * 7/2000 Kartisek ..... A01G 13/0287 383/4
6,276,698 B1 * 8/2001 Calandra ..... B62B 15/00 280/18
6,364,324 B1 * 4/2002 Buchanan ..... B62B 13/06 280/11.18
6,565,101 B2 * 5/2003 Jones, Jr. ..... B62B 15/00 280/19
6,651,414 B1 * 11/2003 Sowers ..... A01D 43/06 56/16.8
6,708,776 B2 * 3/2004 Harwood ..... A01B 31/00 172/612
7,032,906 B1 * 4/2006 Wright ..... B60D 1/00 280/18
D578,598 S * 10/2008 Anderson ..... D22/108
7,540,102 B2 * 6/2009 Olmr ..... E01H 5/04 37/245
7,726,710 B2 * 6/2010 Handwerker ..... E04G 21/24 294/215
8,814,180 B1 * 8/2014 Arnurius ..... B60D 1/143 280/19
2005/0120692 A1 * 6/2005 Kim ..... A01D 51/00 56/1
2006/0021311 A1 * 2/2006 Kim ..... A01G 20/30 56/1
2006/0055130 A1 * 3/2006 Williams, Jr. ..... B60D 1/00 280/24
2006/0232082 A1 * 10/2006 Tiura ..... B65F 1/00 294/214
2008/0191501 A1 * 8/2008 Monahan ..... B65F 1/00 294/214
2010/0008601 A1 * 1/2010 Prudencio ..... B65F 1/00 383/4
2011/0197479 A1 * 8/2011 Secker ..... A01D 51/002 37/197
2012/0074679 A1 * 3/2012 Kinsey ..... B62B 15/007 280/845
2013/0181416 A1 * 7/2013 Ross ..... B62B 15/00 280/18

* cited by examiner

SNOW REMOVAL SYSTEM AND METHOD

CROSS-REFERENCE TO RELATED APPLICATIONS

This application claims the benefit of provisional U.S. Application 62/308,448 filed Mar. 15, 2016.

FIELD OF INVENTION

This invention relates to snow removal. More particularly, this invention relates a system and method for removing snow from athletic fields and other large surfaces easily damaged by conventional snow removal methods and systems.

BACKGROUND

Artificial turf fields and other outdoor decorative or sporting surfaces can be used during winter months provided they are not blanketed in snow. When snow accumulates, it can be removed with shovels, a snow plow, snow blowers, or other snow removal methods. Unfortunately, however, most snow removal methods are either too cumbersome to practically remove snow from large areas or too damaging to the underlying surface. For example, for the majority of athletic turf fields, snow is removed using modified snow plows or pusher blades. Although snow plows or pusher blades are effective when removing snow from large areas, these modified plows typically are damaging to the athletic turf fields and surrounding areas. Often the crumb rubber or other type of infill mix is scraped off of the field along with the snow, and when warm weather arrives, it can be found in piles where the removed snow had been placed. Also, the blades and other edges of the plows can cause the turf seams to separate or cause other damage. Snow blowers are somewhat less damaging to the underlying surface, but they only move the snow a short distance, which is not practical for large areas. Accordingly, it would be desirable to provide a less damaging system and method for removing snow from athletic turf fields and other large decorative or easily damaged surfaces.

SUMMARY OF THE INVENTION

A system and method for removing snow from surfaces and areas that area susceptible to damage from conventional snow removal methods is described herein. Specifically, a system and method for removing snow from an artificial turf field is described herein. In this system, a modified snow blower is used in combination with a first vehicle towing a sled to remove snow from the artificial turf field. The sled is formed using a large flexible sheet surrounded at its perimeter by first and second straps and first and second draw bars. Preferably the first and second straps combine to form a single continuous strap that encases the flexible sheet's edge, such as using a four inch wide polyester strap that folds over the flexible sheet's edge so that two inches rest on the upper side of the flexible sheet and two inches rest on the lower side of the flexible sheet. Preferably the flexible sheet is a polymer sheet. The sled also includes trailer attachments near each draw bar, and preferably the trailer attachments are extensions of the first and second straps or part of a continuous combined strap. The snow blower is a conventional snow blower that is modified with an edge guard covering the snow blower's blade or cutting edge. The edge guard is preferably attached to the snow blower's auger housing using the snow blower's original skid plate attachment components. The snow blower is further modified with an axle and a pair of wheels positioned behind the auger to slightly raise the blower and improve its performance.

To use the system, the first vehicle pulls the sled at a first speed, and the modified snow blower is pushed manually or with a second vehicle alongside the sled at a second speed. The discharge chute of the snow blower is adjusted so that it discharges snow onto the sled. When the sled collects a desired amount of snow, it is taken to a snow disposal area. The snow is removed from the sled, and then the sled returns to its position next to the snow blower. The process repeats until the desired amount of snow has been removed.

In an alternative embodiment, the snow blower first clears a path wide enough for the first vehicle to travel. Then, the first vehicle, modified with a quick release vehicle attachment, attaches to a quick release strap extension modification and pulls the sled behind and substantially laterally offset from the first vehicle. In this embodiment, the sled skims the snow so that it accumulates on top of the sled. When the sled has reached a desired capacity of collected snow, the sled is detached from the first vehicle. Then, either the first vehicle or another vehicle can attach to the sled at its end to pull it to a disposal area. The snow is removed from the sled, and the sled can then be returned to its last position. The process repeats until the desired amount of snow has been removed.

This brief description of the invention is intended only to provide a brief overview of subject matter disclosed herein according to one or more illustrative embodiments, and does not serve as a guide to define or limit the scope of the invention. This brief description is provided to introduce an illustrative selection of concepts in a simplified form that are further described below in the detailed description. This brief description is not intended to identify key features or essential features of the invention, nor is it intended to be used as an aid in determining the scope of the invention.

BRIEF DESCRIPTION OF THE DRAWINGS

The accompanying drawings are provided to illustrate features of certain embodiments of the invention referenced in the detailed description of the invention that follows. As the drawings illustrate only certain embodiments of this invention, they are not to be considered limiting of its scope, and it should be understood that the scope of the invention encompasses other equally effective embodiments. The drawings are not necessarily to scale and are generally provided to illustrate the features of certain embodiments of the invention. In the drawings, like numerals are used to indicate like parts throughout the various views. Thus, for further understanding of the invention, reference can be made to the following detailed description, read in connection with the drawings listed below.

DETAILED DESCRIPTION OF THE INVENTION

Figure 1:
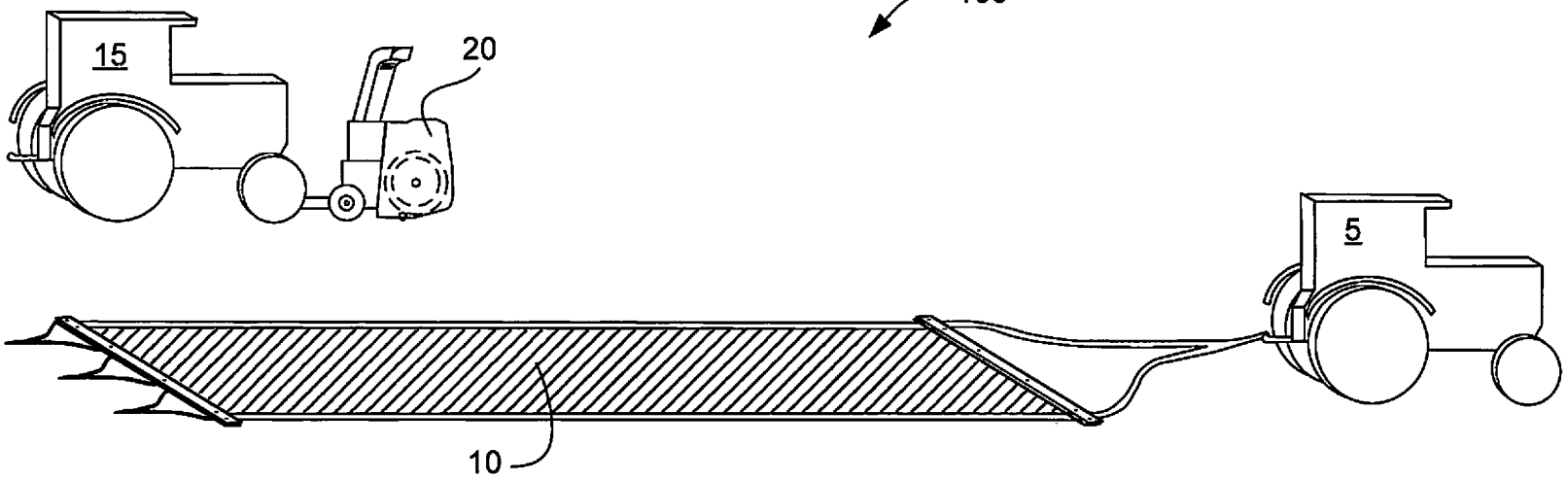
FIG. 1 is an isometric view of an exemplary modified snow blower of the present invention positioned alongside an exemplary sled coupled to a carrying vehicle according to an embodiment of the present invention.

Snow removal system 100 is shown in FIG. 1 and includes a sled 10, a first vehicle 5 for moving the sled 10, a snow blower 20, and an optional second vehicle 15 for moving the snow blower 20. First vehicle 5 and optional second vehicle 15 can be any type of carrying vehicle such as, for example, a tractor, cart, utility vehicle, or truck. The snow removal system is useful for removing snow from any surface and is particularly useful when it is desirable to remove snow with a snow blower rather than a plow or pusher blade.

FIGS. 1 and 2A-2C illustrate sled 10. Sled 10 includes a large somewhat flexible sheet 11 capable of hauling snow. Preferably, sheet 11 is a polymer sheet with a thickness of about ⅛ inch. For example, sheet 11 may be a high molecular weight polyethylene sheet. Sheet 11 is defined at its perimeter by first, second, third, and fourth edges 11*a*, 11*b*, 11*c*, and 11*d* respectively. The sled can be any size, but is preferably rectangular shaped. For example, sheet 11 can be 8 feet wide by 40 feet long. The sled 10 can be a free standing unit, allowing for a first (carrying) vehicle 5 to be coupled to or removed from the sled 10. Once the sled 10 has been correctly attached to the first vehicle 5, the snow removal method can be adjusted dependent on thickness of the snow on the athletic field 14.

Figure 2A:
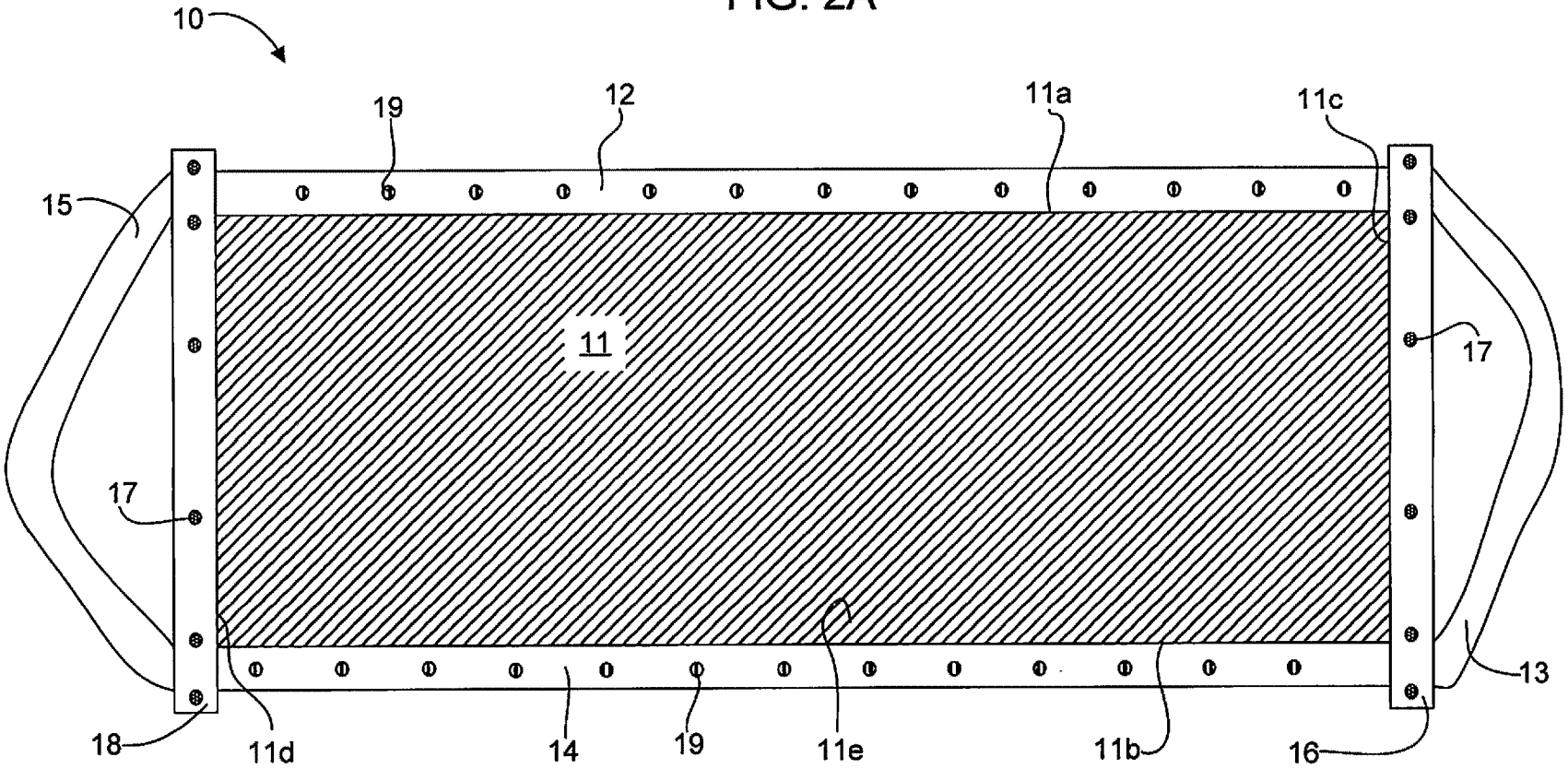
FIG. 2A is a top view of the exemplary sled according to an embodiment of the present invention.
Figure 2B:
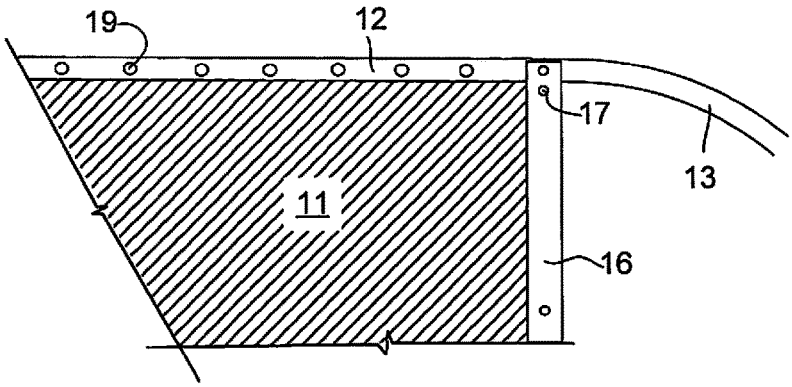
FIG. 2B is an enlarged partial top view of the exemplary sled, illustrating draw bar details and strapping details according to an embodiment of the present invention.
Figure 2C:
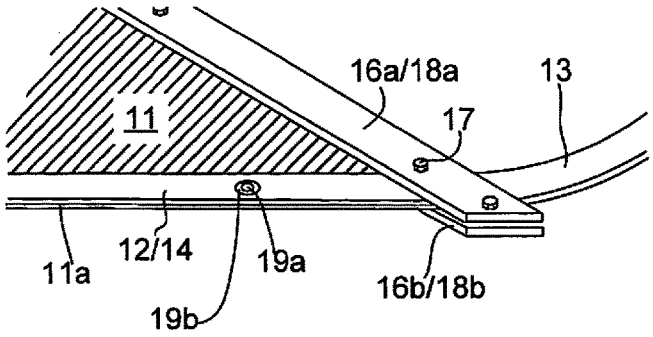
FIG. 2C is an enlarged partial isometric view of the exemplary sled, illustrating draw bar details and strapping details according to an embodiment of the present invention.
Figure 2D:
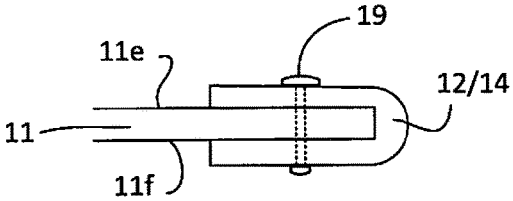
FIG. 2D is a partial side view of the sheet with strap attached, illustrating the details of strap attachment according to an embodiment of the present invention.

As shown in FIG. 2A, along the opposing first and second edges 11*a* and 11*b* of sled 10 are a first strap 12 and second strap 14 respectively. First and second straps 12 and 14 are preferably fixedly attached to sled edges 11*a* and 11*b*. Preferably, straps 12 and 14 may be sewn on, adhered, bonded, or otherwise substantially permanently secured along edges 11*a* and 11*b* and on its upper side 11*e*. Alternatively, straps 12 and 14 are removably attached to edges 11*a* and 11*b* so that they or sheet 11 can be replaced when worn. In a preferred embodiment, straps 12 and 14 combine or are integral with each other so that they form a continuous single strap that surrounds the entire perimeter of sheet 11 along edges 11*a*, 11*b*, 11*c*, and 11*d*. Additionally, in the preferred embodiment, straps 12 and 14 also encase the edge of sheet 11 so that one half of the straps' widths rests on the upper side 11*e* of sheet 11 and the other half of the straps' widths rest on the lower side 11*f* of sheet 11. For example, where the straps are 4 inches wide, which is the preferred width, two inches rest on the upper surface and two on the lower surface of sheet 11. FIG. 2D illustrates straps 12 and 14 made of four inch polyester strapping that fold over the edges of sheet 11 to encase the edge. Further, the strap is attached to the sheet 11 using 3/16 inch diameter button head rivets 19*a* and 1½ inch fender washers 19*b* spaced about 18 inches apart along the length of the strap at about its center as shown in FIG. 2A. Straps 12 and 14 preferably are strapping or webbing such as two inch nylon strapping or four inch polyester strapping. Straps 12 and 14 also may be multiple layers so that they attach to the upper and lower sides of sheet 11 to partially encase sheet 11 and provide extra strength.

At each of the opposing ends of sled 10 situated at opposing edges 11*c* and 11*d* are optional first and second draw bars 16 and 18, respectively. Preferably sled 10 includes draw bars 16 and 18 to increase the strength of sled 10 and maintain the structural integrity of sled 10. As shown in FIGS. 2A-2C, preferably each draw bar 16 and 18 has two layers. For example, first draw bar 16 includes a first upper bar 16*a* and a first lower bar 16*b*, and second draw bar 18 includes a second upper bar 18*a* and a second lower bar 18*b*. Each of the upper and lower bars is preferably comprised of a lightweight but rigid material. For example, upper and lower bars may be comprised of ¼ inch aluminum that is 3 inches wide and of a length that compliments the edges 11*c* and 11*d* of sheet 11. Preferably, the upper 16*a*, 18*a* and lower bars 16*b*, 18*b* are placed above and below sheet 11 and straps 12 and 14 such that they encase sheet 11 and the straps as shown in FIG. 2C. Preferably the upper 16*a*, 18*a* and lower bars 16*b*, 18*b* are held together by connectors 17 such as nuts and bolts, screws, locking mechanisms, or other connectors as is known in the art. For example, upper bars 16*a*, 18*a* and lower bars 16*b*, 18*b* may define one or more holes to accommodate 5/16 carriage bolts with locking nuts to secure the upper and lower bars together. Upper bars 16*a*, 18*a* and lower bars 16*b*, 18*b* further may extend past the edges of sheet 11 as shown in FIG. 2C or preferably are slightly inset from the edges of sheet 11 as shown in FIGS. 2A and 2B.

Sled 10 further includes near opposing edges 11*c* and 11*d* one or more trailer attachments to facilitate coupling the sled to the first carrying vehicle 5 or to an additional removal vehicle 6. As shown in the figures, first and second trailer attachments can be an optional first strap extension 13 and an optional second strap extension 15. First and second strap extensions may both be present on sled 10 or only one may be present. First and second strap extensions are tow straps that can be used to directly couple sled 10 to first vehicle or may be combined with any conventional trailer attachment for facilitating a connection between sled 10 and first vehicle 5. Alternatively, conventional trailer attachments or other attachment components can be directly attached to the first or second draw bars 16 and 18 to facilitate a connection or coupling between sled 10 and first vehicle 5. Strap extensions may be the same material as straps 12 and 14 or another type of strapping or webbing material. Preferably, strap extensions 13 and 15 are comprised of the same material as first and second straps 12 and 14 and more preferably comprise four inch wide polyester strapping. Additionally, preferably strap extensions 13 and 15 are integral with or fixedly attached to first and second straps 12 and 14 such that the combination substantially creates a loop as illustrated in FIG. 2A.

Figure 2E:
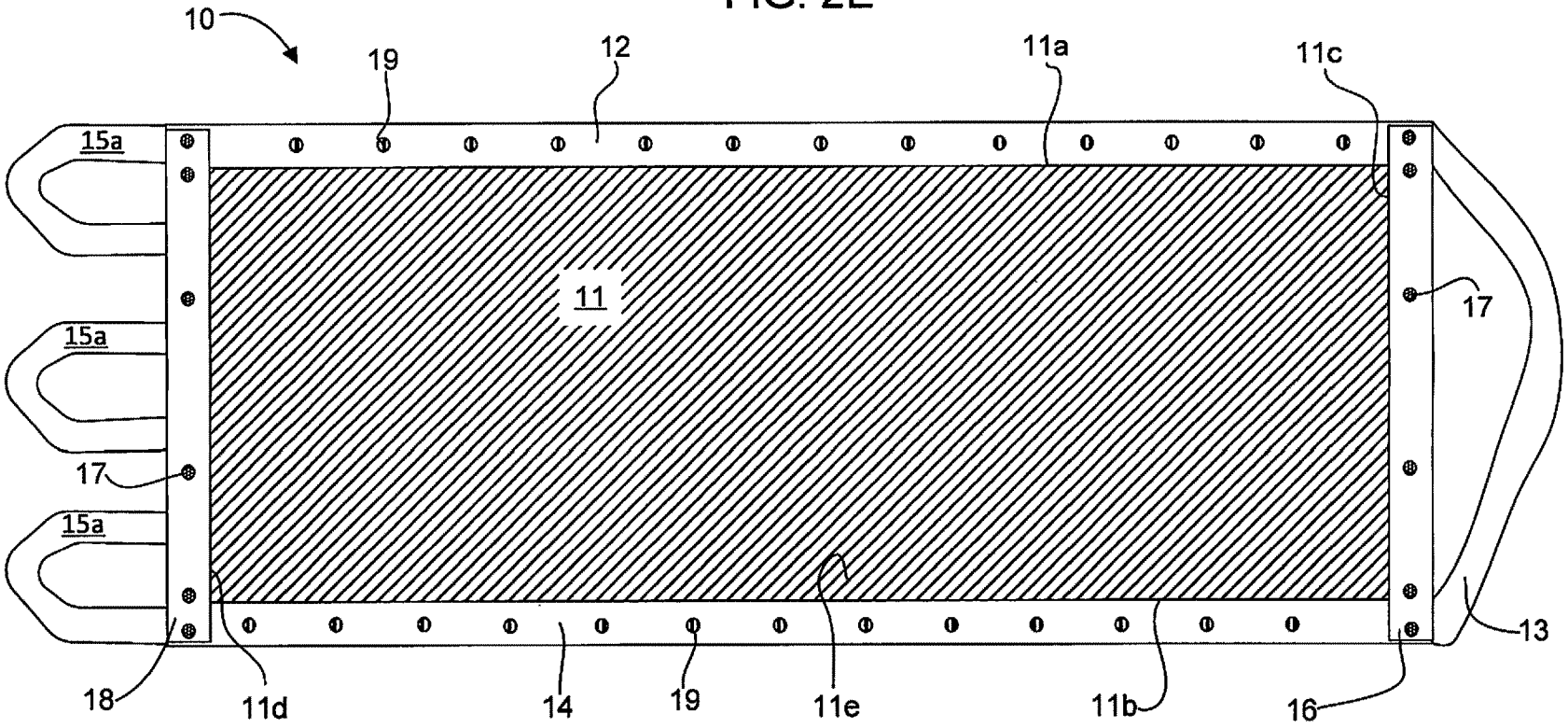
FIG. 2E is a top view of the sled according to an alternative embodiment of the present invention.
Figure 2F:
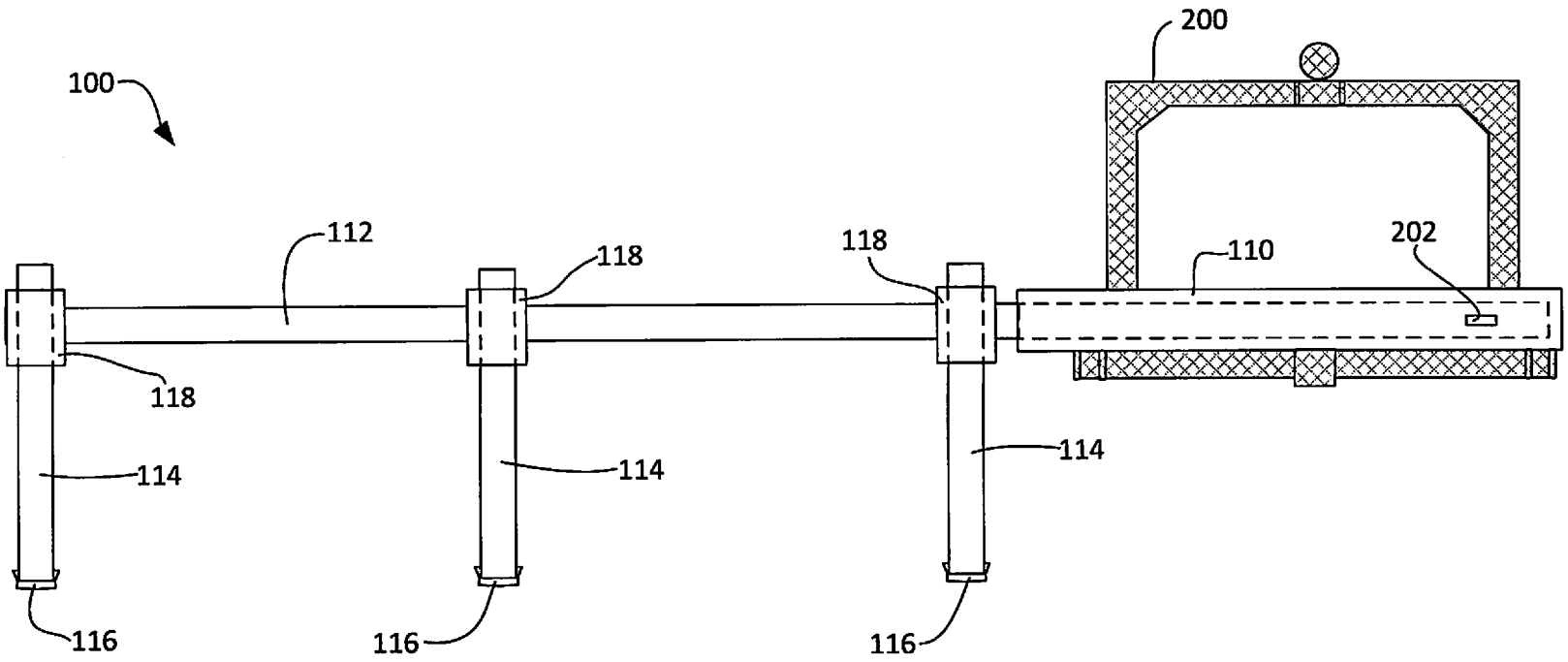
FIG. 2F is a side view of a vehicle attachment that cooperates with the sled shown in FIG. 2E according to an alternate embodiment of the present invention.

FIGS. 2E and 2F illustrate an alternative embodiment of the sled 10 with a quick release strap extension arrangement and a cooperating quick release vehicle attachment. Preferably, the sled has one end with a quick release strap extension 15*a* arrangement and a second end with a single strap extension 13 as shown in FIG. 2E. As further shown in FIG. 2E, the strap extension arrangement can be a series or plurality of strap extensions 15*a*. As with single strap extensions 13 and 15, strap extensions 15*a* may be the same material as straps 12 and 14 or another type of strapping or webbing material. Preferably, strap extensions 15*a* are comprised of the same material as first and second straps 12 and 14 and more preferably comprise four inch wide poly strapping. Additionally, preferably strap extensions 15*a* are integral with or fixedly attached to first and second straps 12 and 14 and strap extension 13 such that the combination substantially creates a loop as illustrated in FIG. 2E.

The cooperating vehicle attachment 100 is configured to cooperate with a trailer hitch on the carry vehicle 5 with mount 110. Mount 110 secures to the hitch and provides a channel (not labelled) through which a lateral support 112 can be inserted so that it extends out to the side of the cooperating vehicle at about a 90 degree angle to the vehicle. Preferably mount 112 is 48 inches to 54 inches long and is fixedly attached to the hitch. FIG. 2F illustrates a preferred way of welding or otherwise fixedly attaching mount 110 to a trailer hitch 200. Lateral support 112 preferably has outer dimensions that matches the inner dimensions of the channel in mount 110, has a first end that is distal to mount, and a second end that inserts into mount 110. For example, lateral support 112 is preferably a square steel tube that measures 2 inches, and mount 110 preferably defines a square channel that measures 2 inches. Lateral support 112, when inserted into the channel of mount 110, preferably can be secured with a locking mechanism such as a pin and clip arrangement 202, as is commonly known to those skilled in the art. Support 112 may be a single piece about twelve feet long or multiple shorter length tubes serially attached. At regular intervals along support 112, two or more legs 114 attach perpendicularly to support 112. Preferably the legs attach near the support's first end and then in equal distances between that first end over about eight feet or a span of support 112 that is about the same length as the width of sheet 11. For example, where sheet 11 is eight feet wide and twenty feet long, legs 114 are attached at regular intervals spanning about eight feet. The distance between the leg 114 closest to mount 110 is preferably about four feet, but can be any length depending on the amount of offset desired between the carrying vehicle's 5 traveling path and the sled's traveling path.

Legs 114 are preferably two inch square steel tubes and about two feet long. Legs 114 have a first end 114*a* that attaches to support 112. Legs attach to support 112 near first end 114*a* with brackets 118 as shown in FIG. 2F, and preferably legs 112 are vertically adjustable within brackets such that the height of legs 112 can be raised or lowered. Brackets 118 preferably define a channel (not labelled) with inside dimensions that cooperate with the outside dimensions of legs 112, and legs 112 can be secured within brackets 118 with a locking mechanism such as, for example, a pin and clip arrangement as discussed above. Legs can be adjusted, for example, where multiple pin holes are positioned along each leg so that the pin and clip arrangement can be positioned at a desired location or height along the leg 114. Brackets 118 preferably are fixedly attached to support 112 or integral with support 112. Where support 112 is formed from multiple serial segments, brackets 118 may be sandwiched or positioned at the intersection of the support segments.

Legs 114 also have a second end 114*b* to which a foot 116 attaches. Foot 116 preferably extends from leg 114 preferably in a direction facing the vehicle and is configured to catch an extension 15*a* so that the extension can be pulled by the cooperating leg 114 when sled 10 is attached to the carrying vehicle. For example, foot 116 may be a hook, notch, protrusion, or other structure that is designed to catch the strap when positioned or slid near the strap. Each foot 116 is further configured to protect the end of each leg and skim over the top of the field being serviced. For example, the feet 116 may be caps that attaches to legs 114 by welding or tension and that are positioned such that when in use about ¾ inches from the athletic field surface. Feet 116 catch the strap extensions 15*a* and then legs 114 can each partially support the weight of the sled when tension is applied to the strap extensions 15*a*. Preferably, there are an equal number of legs 114 with feet 116 as there are extensions 15*a*.

Figure 3:
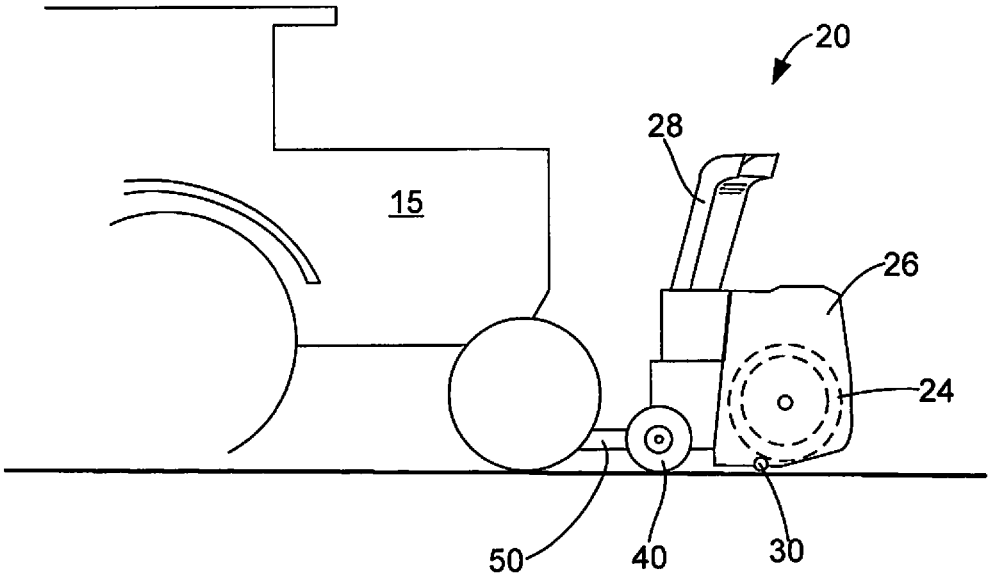
FIG. 3 is an illustration of a side view of an exemplary snow blower and optional second vehicle according to an embodiment of the present invention.
Figure 4A:
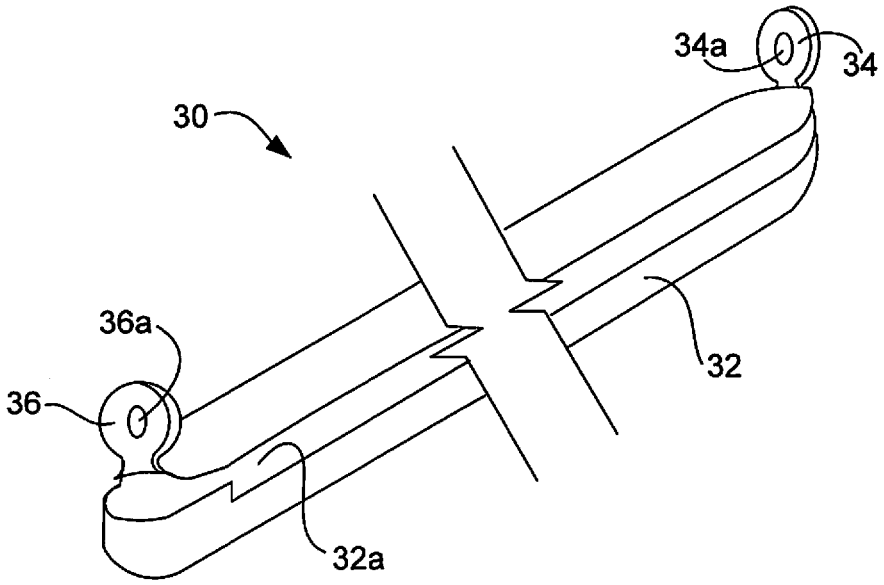
FIG. 4A is an isometric illustration of an exemplary edge guard according to an embodiment of the present invention.
Figure 4B:
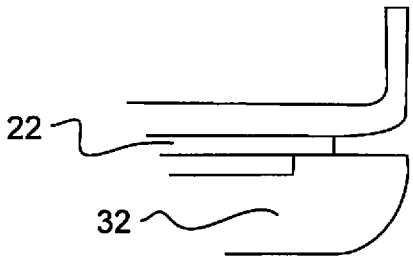
FIG. 4B is a partial front view the edge guard mounted over the original equipment manufacturing cutting edge of the blower according to an embodiment of the present invention.
Figure 4C:
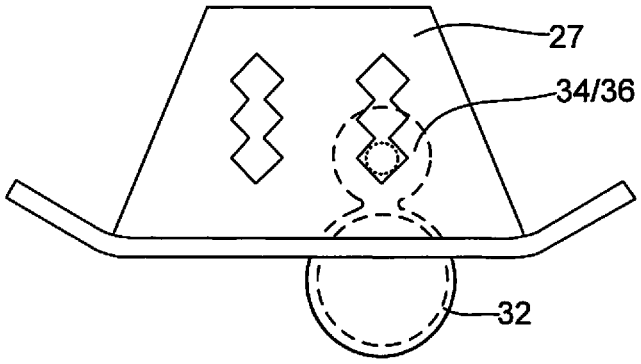
FIG. 4C is a side view showing the edge guard mounted over a cutting edge and positioned on an original equipment manufacturing skid plate or shoe according to an embodiment of the present invention.

The snow blower 20 is a conventional snow blower such as one with an auger 24, auger housing 26, cutting blade 22, discharge chute 28, and skid plates or shoes 27. In the present invention, the snow blower is modified, however, with an edge guard 30 that is mounted to the auger housing 26 so that it covers the snow blower's blade or cutting edge 22 to protect the turf from cutting edge 22. Edge guard 30 is shown in FIGS. 3 and 4A-4C and generally comprises a cover 32, a first attachment plate 34 that defines an opening 34*a*, and a second attachment plate 36 that defines an opening 36*a*. Cover 32 may rest against cutting edge 22 or may defined a cavity 32*a* into which cutting edge 22 can be placed. The edge guard 30 is preferably attached to the snow blower's auger housing 26 using the snow blower's original skid plate 27 attachment components as shown in FIG. 4C and oriented so that the cutting edge 22 is positioned in cavity 32*a*. Cover 32 is preferably a modified two inch steel pipe, and attachment plates 34 and 36 are preferably ⅜ by ½ inch spacers. For example, the edge guard 30 can be mounted by removing two carriage bolts that are used to hold the originally installed adjustable skid plates 27, and then the carriage bolts can be reinstalled through the openings 34*a*, 36*a* defined by attachment plates 34, 36, through the skid plates 27 and then auger housing 26, followed by lock nuts.

Figure 5:
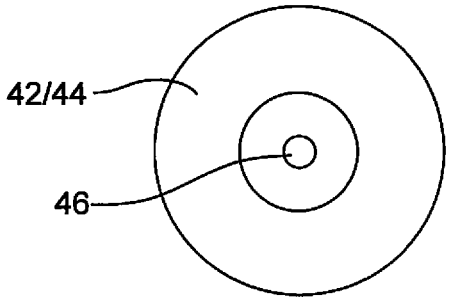
FIG. 5 is an illustration of the exemplary wheels used in a wheel kit.

The snow blower 20 may further be modified with a wheel kit 40 that includes a pair of wheels 42, 44 positioned behind the auger 24 and housing 26 to slightly raise the blower and improve its performance. FIGS. 3 and 5 illustrate the additional wheel kit 40. Any type of wheel can be added, but preferably a pair of wheels 42, 44 that are 4.10×3.50×4 wheels with inflatable tires or inner tubes are used. Wheels 42 and 44 can be mounted to a shaft 46 just behind the snow blower auger 24 on both sides of the snow blower auger housing 26. The wheels can be mounted on a shaft permanently welded to auger housing 26. Alternatively, they can be mounted to a temporary shaft. Additionally, a nut, such as a ¾ inch nut, located on the shaft 46 can be removed off shaft to mount or dismount either of the wheels 42, 44. Preferably, wheels 42 and 44 include a valve by which the air pressure in the tires or inner tubes can be adjusted. By adjusting the air pressure of wheels 42, 44 slightly, minor height adjustments of the protective edge guard 30, from zero to ¾ inches, for example, may be acquired.

Snow blower 20 may be one that is manually pushed by its operator. Alternatively, snow blower 20 may be one that attaches to a tractor or other vehicle as shown in FIGS. 1 and 3. Where it attaches to a vehicle 15 as shown, it attaches with standard attachment means 50. Standard attachment means 50 is any known arrangement for attaching a snow blower to a carrying vehicle, as will be understood by those skilled in the art.

Figure 6:
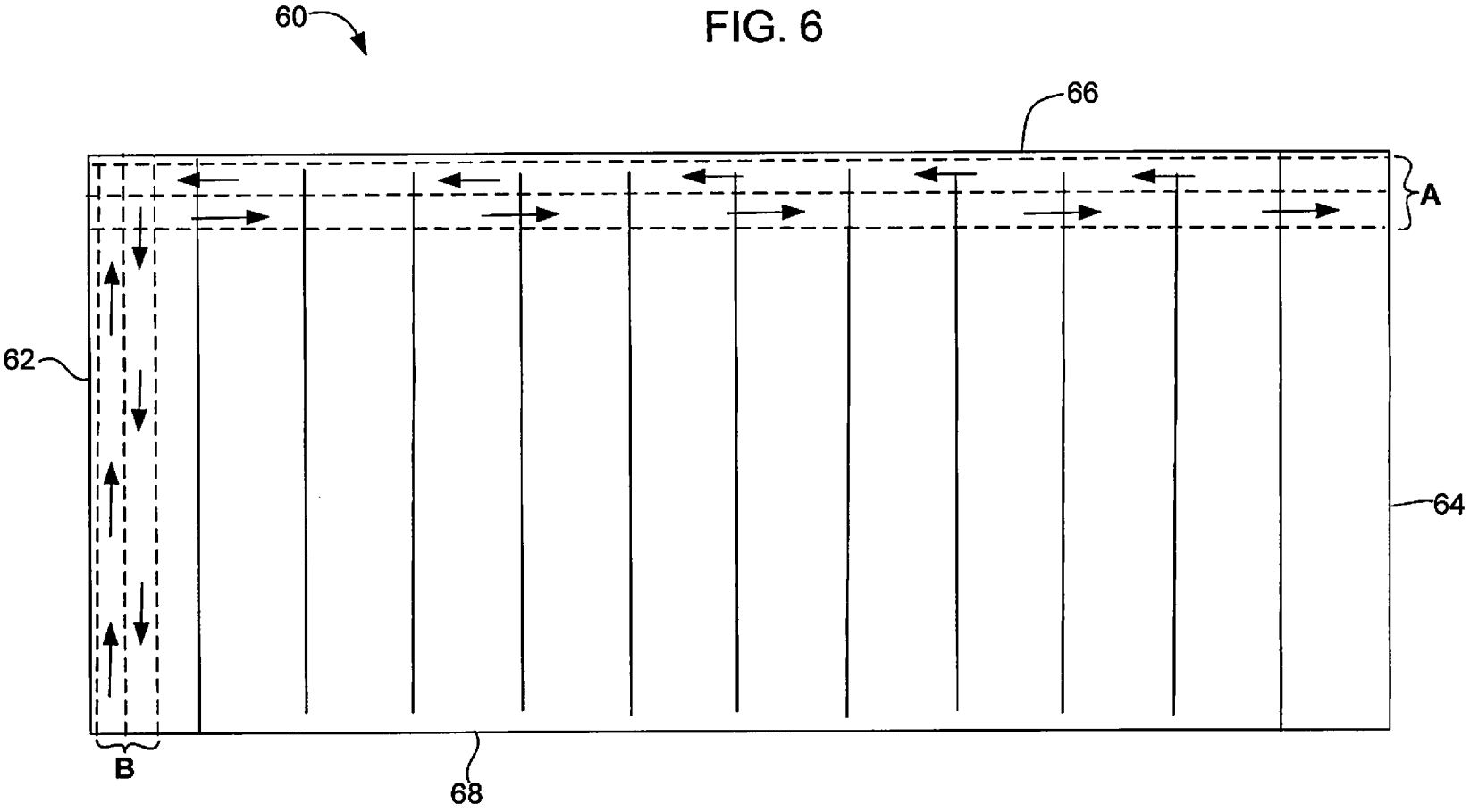
FIG. 6 illustrates an example of an athletic field.
Figure 7:
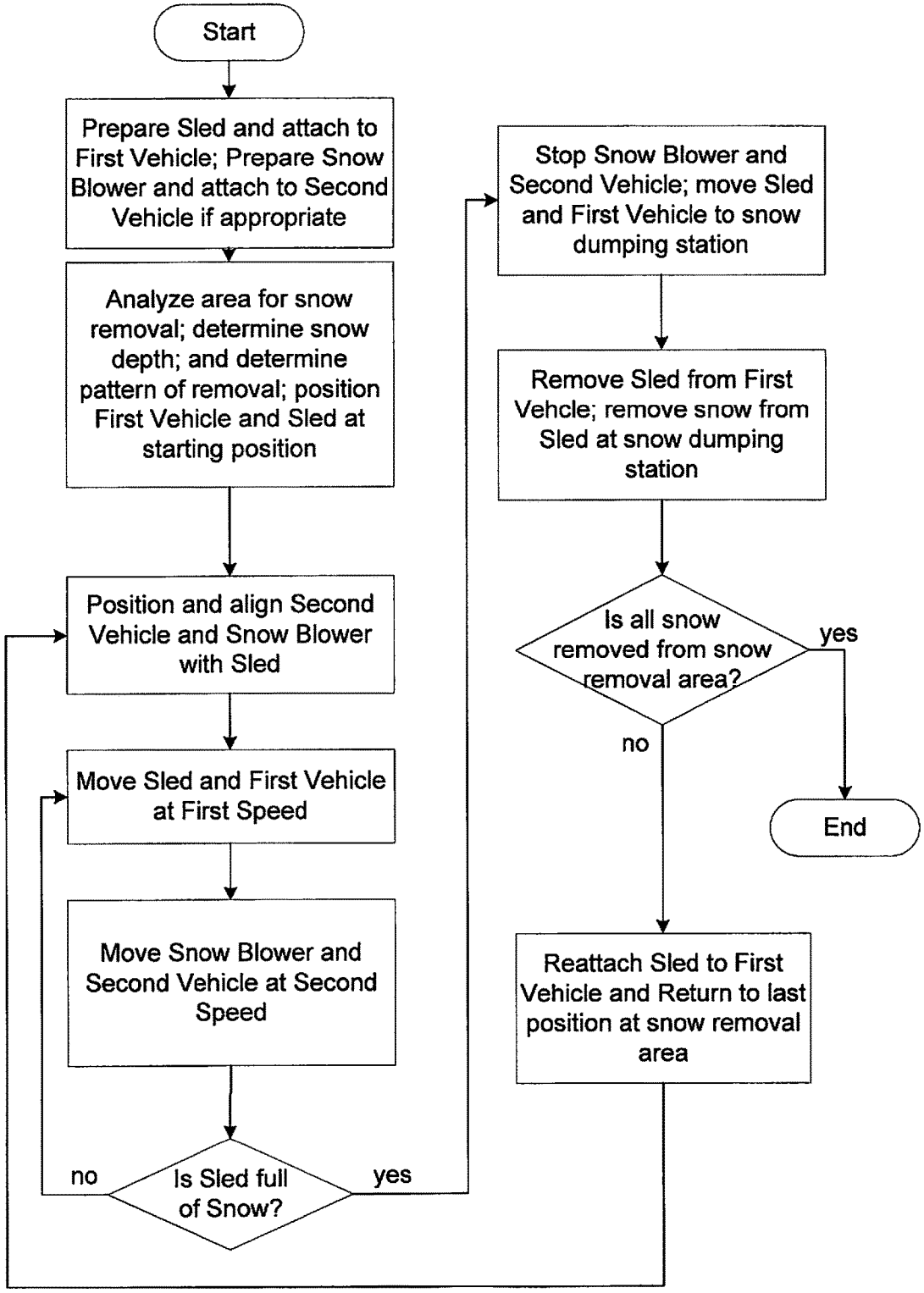
FIG. 7 illustrates a method for using the modified snow blower and sled according to an embodiment of the present invention.

In operation and in accordance with an embodiment, sled 10 can be unrolled from a stored position, with the upper side 11*e* of sheet 11 facing up and, where straps 12 and 14 are only attached to the upper side 11*e* of sheet 11, with straps 12 and 14 facing up as well. Once unrolled, sled 10 can be coupled to a hitch on first vehicle 5 using either of strap extensions 13, 15. Alternatively, where multiple strap extensions 15*a* are present, sled 10 may be attached to legs 114 and feet 116 on vehicle attachment 100, which is mounted on a hitch on vehicle 5. Sled 10 can then be towed to its starting position on the area needing snow removal. FIG. 7 illustrates a method of use for system 100 after the sled has been attached to a vehicle, and FIG. 6 illustrates a field 60 where system 100 may be used. As shown in FIG. 6, athletic field 60 is defined at its perimeter by a first end 62, a second end 64, a first side 66, and a second side 68.

Before beginning snow removal, it is preferable to determine the optimal snow removal route. In other words, preferably the operators of system 100 map out how the direction they will drive the first and second vehicles before starting. As shown in FIG. 6, the particular route the operators select to remove the snow can depend on the depth of the snow and the size and shape of the area to be cleared. For example, as will be further described below, with a snow depth of 2-5 inches, multiple end 62 to end 64 passes on a standard size rectangular athletic field 60 can be used. With depths of five inches or more, however, multiple side 66 to side 68 passes may be used. In an example, if the snow is greater than 1 inch and less than five inches deep, starting at one end of the field 60, the snow removal system can proceed heading in the direction from end 62 to end 64, i.e., along the length of the field 60 as shown by arrows in section A. If the snow depth is greater than 5 inches, the snow removal system can operate from side 66 to side 68, i.e., across the width of the field 60 as shown by arrows in section B.

Once the depth of the snow on the field 60 and the subsequent orientation of the removal system have been determined, the snow blower 20 can be positioned alongside and at the rear of the sled 10. The snow blower 20 should be positioned so that its discharge chute 28 is aimed to deposit discharged snow on sled 10. The sled vehicle 5 and the snow blower 20 (or snow blower 20 and attached vehicle 15) begin to move at the same time. While the snow blower 20 maintains the same steady speed, the vehicle 5 pulling the sled 10 varies its speed to ensure that the snow exiting the snow blower 20 is evenly distributed over the entire sled 10. For example, vehicle 5 may start at a slow speed and then increase its speeds until the snow blower 20 reaches the front of the sled 10. This variation in speed positions the snow from back to front and then from front to back evenly throughout sled 10.

The discharge chute 28 of the snow blower 20 can be maneuvered in order to adjust the arc of the discharged snow and the landing position of the snow relative to the snow blower 20. Because of this adjustability in the distance of the landing snow from the snow blower 20, the distance of between sled 10 and the snow blower 20 can also be adjusted. In an example, the snow blower 20 and the sled 10 can move together such that the spacing between the snow blower 20 and the sled 10 is maintained. In another example, the sled 10 can be moved repeatedly along the same line while the snow blower 20 moves along several lines. In this example, the spacing between the snow blower 20 and the sled 10 increases as the snow blower 20 moves along successive lines.

Once the sled 10 is full or has accumulated a desired amount of snow, the vehicle 5 pulling the sled simply pulls off the field 60 without stopping until the vehicle 5 reaches a desired snow dumping destination or disposal area. The vehicle 5 is then unhooked from the sled 10 and the vehicle 5 is repositioned alongside the polymer sled 1 and facing in the opposite direction the vehicle 5 was pulling the polymer sled 10 originally. The sled 10 is again coupled to the vehicle 5 and the vehicle 5 begins to pull and overturn the sled 10, which then causes the snow to be dumped off of sled 10. In some cases, the sled can be pulled so that it folds over on top of itself as it dumps the snow and ends up upside down relative to its initial position. Then, depending on the embodiment of sled 10, it can either be used with the lower surface 11*b* of sheet 11 facing up or it may be returned to a position where the sheet upper surface 11*a* is facing up. Where the sled has to be returned to an upper surface 11*a* of the sheet facing up, then the polymer sled 10 will need to be recoupled to the vehicle 5. In an embodiment, the sled 10 is manually returned to the position with the upper surface 11*a* of sheet 11 facing up or it can be pulled to that position with carrying vehicle 5. Where the straps encase sheet 11 so that they partially extend over sheet 11 on both the upper and lower surfaces 11*a* and 11*b* as shown in FIG. 2D, the sled is reversible and can be used with either the upper surface 11*a* or the lower surface 11*b* of sheet 11 facing up. After sled 10 is reoriented without the snow, vehicle 5 then returns to the field for further snow removal, and the process of snow removal is repeated, moving either side-line to side-line or end-line to end-line depending on the amount of snow on the field 60, until the snow has been removed from the field 60.

Figure 8:
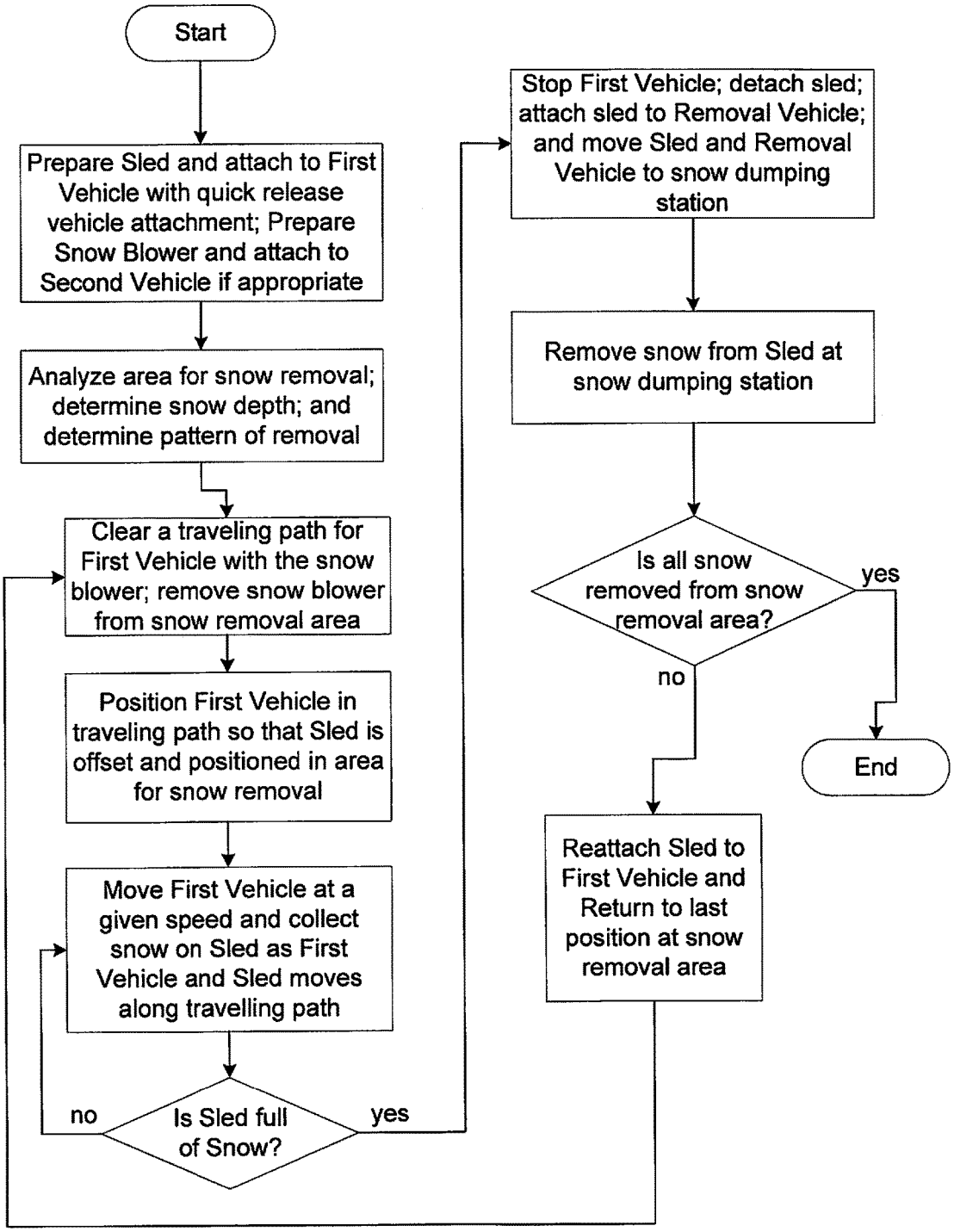
FIG. 8 illustrates a method for using the sled according to an alternative embodiment of the present invention.
Figure 9A:
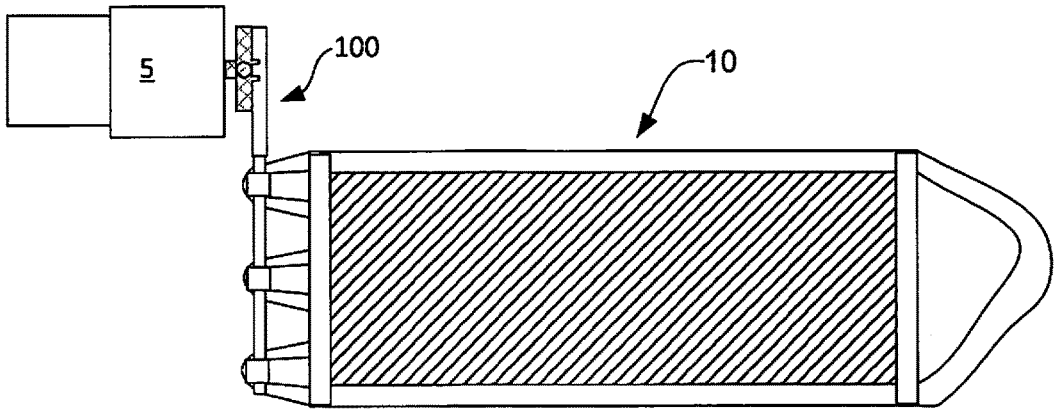
FIG. 9A illustrates an embodiment of the snow removal system when the sled is attached to a first carrying vehicle with a quick release vehicle attachment according to an alternative embodiment of the present invention.
Figure 9B:
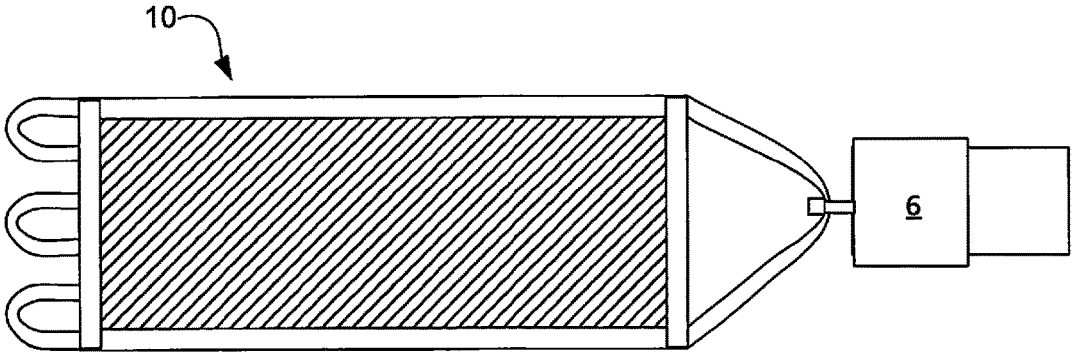
FIG. 9B illustrates an embodiment of the snow removal system when the sled is attached to a removal vehicle according to an alternative embodiment of the present invention.

In an alternative method of removing snow with sled 10, where the snow accumulation is preferably over six inches, sled 10 can be used to directly remove the snow without help from the snow blower. With this embodiment, as illustrated in FIGS. 8, 9A, and 9B, the snow blower may be used to first clear a driving path for vehicle 5. The quick release vehicle attachment 100 is then attached to vehicle 5, and sled 10 is oriented so that quick release strap extensions 15*a* can cooperate with legs 114 of vehicle attachment 100 as shown in FIG. 9A. Once strap extensions 15*a* are positioned so that sled 10 can be pulled with vehicle attachment 100, vehicle 5 can travel along the path cleared by the snow blower. Because the sled is offset from vehicle 5, it travels in a path parallel to but in the same direction as vehicle 5. This allows sled 10 to scoop or skim the accumulated snow onto the sled as vehicle 5 travels along the cleared path. When the snow carried on the sled reaches a desired amount, first vehicle 5 backs up slightly to release strap extensions 15*a* from legs 14, and then either vehicle 5 or a third removal vehicle 6 can attach to the opposite end of sled 10, preferably to strap extension 13 as shown in FIG. 9B to pull sled 10 to a snow dumping location. Snow can be removed from sled 10 as discussed above. After the snow is removed, sled 10 can be recoupled to vehicle 5 if needed, and the sled can return to its last snow removal position for further snow removal.

In using this system, the weight of the equipment and snow is distributed over a relatively large area, thus resulting in less damage to the turf field and no movement of the crumb rubber and infill mix.

This written description uses examples to disclose the invention, including the best mode, and also to enable any person skilled in the art to practice the invention, including making and using any devices or systems and performing any incorporated methods. The patentable scope of the invention may include other examples that occur to those skilled in the art. It is to be understood that while specific dimensions are provided herein, the invention is not limited to the specific dimensions listed herein. It will also be understood that, although the exemplary embodiments have been described with respect to removing snow from athletic fields and, in particular, artificial turf fields, the systems and methods described herein can be used on other surfaces (e.g., natural grass, asphalt, concrete, paving, etc.). Accordingly, while there has been illustrated and described what is at present considered to be the preferred embodiment of the present invention, it will be understood by those skilled in the art that various changes and modifications may be made and equivalents may be substituted for elements thereof without departing from the true scope of the invention disclosed, but that the invention will include all embodiments falling within the scope of the claims.

I claim:

1. A snow removal system for removing snow from easily damaged surfaces comprising:

a. a first vehicle comprising a hitch;

b. a quick release vehicle attachment mounted to the hitch of the first vehicle wherein the quick release vehicle attachment comprises:

i. a mount coupled to the hitch and defining a channel;

ii. a lateral support disposed in the channel of the mount and oriented to extend to the side of the first vehicle;

iii. a plurality of vertically adjustable legs having a first end and a second end, wherein the first end of each leg is attached perpendicular to the lateral support; and iv. a plurality of feet fixedly attached to a second end of each leg; and c. a sled comprising:

i. a sheet having at least a perimeter comprised of first, second, third, and fourth edges;

ii. a first strap fixedly attached along the first edge;

iii. a second strap fixedly attached along the second edge;

iv. a first draw bar fixedly attached to a third edge of the sheet;

v. a second draw bar fixedly attached to a fourth edge of the sheet;

vi. a first strap extension fixedly attached to the first draw bar; and vii. a plurality of second strap extensions fixedly attached to the second draw bar wherein each of the second strap extensions cooperates with a leg of the quick release vehicle attachment.

2. The snow removal system of claim 1 further comprising:

a. a removal vehicle comprising a hitch configured to cooperate with the first strap extension of the sled.

3. The snow removal system of claim 1 wherein the first strap encases the first edge of the sheet and the second strap encases the second edge of the sheet.

* * * * *